US011313599B2

(12) United States Patent
Han et al.

(10) Patent No.: US 11,313,599 B2
(45) Date of Patent: Apr. 26, 2022

(54) REFRIGERATOR COOLING SYSTEM CAPABLE OF REGULATING AMOUNT OF REFRIGERANT

(71) Applicant: QINGDAO HAIER CO., LTD., Qingdao (CN)

(72) Inventors: Cong Han, Qingdao (CN); Zhenhua Tian, Qingdao (CN); Xuefeng Han, Qingdao (CN)

(73) Assignee: QINGDAO HAIER CO., LTD., Qingdao (CN)

( * ) Notice: Subject to any disclaimer, the term of this patent is extended or adjusted under 35 U.S.C. 154(b) by 132 days.

(21) Appl. No.: 16/643,556

(22) PCT Filed: Apr. 26, 2019

(86) PCT No.: PCT/CN2019/084459
§ 371 (c)(1),
(2) Date: Feb. 29, 2020

(87) PCT Pub. No.: WO2020/010897
PCT Pub. Date: Jan. 16, 2020

(65) Prior Publication Data

US 2020/0200455 A1 Jun. 25, 2020

(30) Foreign Application Priority Data

Jul. 13, 2018 (CN) ..... 201810771514.5

(51) Int. Cl.
*F25B 45/00* (2006.01)

(52) U.S. Cl.
CPC ..... *F25B 45/00* (2013.01); *F25B 2400/16* (2013.01); *F25B 2400/162* (2013.01); *F25B 2600/01* (2013.01); *F25B 2600/2523* (2013.01)

(58) Field of Classification Search
CPC ..... F25B 45/00; F25B 2600/01; F25B 2600/2519; F25B 2600/2523;
(Continued)

(56) References Cited

U.S. PATENT DOCUMENTS 4,238,932 A * 12/1980 Schrader ..... F25B 40/06 62/197
4,805,417 A * 2/1989 Weaver ..... F16L 37/23 62/292
(Continued)

FOREIGN PATENT DOCUMENTS

CN 1979365 A 6/2007
CN 203231423 U 10/2013
(Continued)

*Primary Examiner* — Jerry-Daryl Fletcher
*Assistant Examiner* — Daniel C Comings
(74) *Attorney, Agent, or Firm* — Cheng-Ju Chiang

(57) ABSTRACT

A refrigerator cooling system, comprising a pipe forming a loop and, sequentially provided on the pipe, a compressor, a condenser, a refrigerant amount regulator, a capillary tube, and an evaporator. The refrigerant amount regulator comprises a storage device and an adjustor provided within the storage device. The storage device is provided therein with a storage cavity for holding a refrigerant. The storage device is provided with an opening for the storage cavity to be in communication with the pipe. The adjustor comprises a sealer used for opening or closing the opening.

9 Claims, 2 Drawing Sheets

(58) Field of Classification Search
CPC ..... F25B 2345/001; F25B 2345/002; F25B 2345/006; F25B 2400/16; F25B 2400/162
See application file for complete search history.

(56) References Cited

U.S. PATENT DOCUMENTS

| | | | | |
|---|---|---|---|---|
| 8,713,950 | B2 * | 5/2014 | Roering | F25D 17/02 62/175 |
| 10,240,829 | B2 * | 3/2019 | Richardson | F16K 31/0644 |
| 2015/0330684 | A1 * | 11/2015 | Goel | F25B 41/40 137/14 |

FOREIGN PATENT DOCUMENTS

| | | | | |
|---|---|---|---|---|
| CN | 204953158 | * | 1/2016 | B05B 1/16 |
| CN | 204953158 | U | 1/2016 | |
| CN | 106440566 | A | 2/2017 | |
| CN | 106482303 | * | 3/2017 | F24F 11/00 |
| CN | 106482303 | A | 3/2017 | |
| CN | 109708376 | A | 5/2019 | |

* cited by examiner

REFRIGERATOR COOLING SYSTEM CAPABLE OF REGULATING AMOUNT OF REFRIGERANT

The present application is a 35 U.S.C. § 371 National Phase conversion of International (PCT) Patent Application No. PCT/CN2019/084459, filed on Apr. 26, 2019, which claims the priority to the Chinese Patent Application No. 201810771514.5, filed on Jul. 13, 2018, and titled "REFRIGERATOR COOLING SYSTEM", which is incorporated herein by reference in its entirety. The PCT International Patent Application was filed and published in Chinese.

TECHNICAL FIELD

The present invention relates to the field of refrigerating equipment, and in particular, to a refrigerator cooling system, capable of regulating an amount of refrigerant automatically.

BACKGROUND

In general, a refrigerator is such a device to which a general refrigerating cycle of a circulating refrigerant is applied, so as to supply cold air generated when the liquid refrigerant is evaporated to a storage compartment, such as a freezing compartment and a refrigerating compartment, thereby preserving foods fresh for a long time.

The refrigerator in a prior art includes a compressor, a condenser, a capillary tube and an evaporator which are connected successively to form a loop. A refrigerating capacity, i.e., an amount of refrigerant, in a cooling system is matched mainly in a design stage, and the amount of refrigerant in the cooling system is constant when the refrigerator is in use. However, in actual use, the operation condition of the refrigerator always changes due to a change in an environment temperature, articles loaded in the refrigerator, or the like. At this point, the constant amount of refrigerant in the cooling system may cause a low operating efficiency of the refrigerator. For example, when the environment temperature is relatively high, a large number of articles are placed at a time or the refrigerator is started up, a refrigerating demand is great, and the amount of refrigerant in the system is less than the required amount of refrigerant; when the environment temperature is relatively low or a small number of articles exist in the refrigerator, the refrigerating demand is small, and the amount of refrigerant in the system is greater than the required amount of refrigerant.

For the cooling system, the amount of refrigerant therein affects a refrigerating effect of the system greatly, and either the large or small amount of refrigerant may increase a workload of the compressor, thereby influencing the service life of the compressor, and then causing great power consumption and a poor refrigerating effect of the refrigerator.

SUMMARY

In order to solve the above-mentioned technical problems, the present invention proposes a refrigerator cooling system.

To achieve the above-mentioned objects, the present invention provides the technical solution as follows. A refrigerator cooling system, capable of regulating an amount of refrigerant automatically, includes a pipe which forms a loop and a compressor, a condenser, a refrigerant amount regulator, a capillary tube and an evaporator which are provided on the pipe successively;

the refrigerant amount regulator includes a storage device and an adjustor provided within the storage device, wherein a storage cavity is formed inside the storage device to accommodate a refrigerant, an opening is formed in the storage device to communicate the storage cavity with the pipe, and the adjustor includes a seal configured for opening or closing the opening;

when the refrigerant of the cooling system is required to be increased or reduced, the sealer is separated from the opening to open the opening, the refrigerant in the storage cavity flows into the cooling system or the refrigerant in the cooling system flows into the storage cavity, and after a set period of time, the sealer is attached to the opening to close the opening.

As a further improvement of the present invention, wherein the set period of time ranges from 30 to 120 seconds.

As a further improvement of the present invention, wherein the adjustor further comprises an electromagnet and a magnetic piece connected with the sealer fixedly, wherein the electromagnet is fixed at a side apart from the opening; when the electromagnet is powered on, the magnetic piece moves towards the electromagnet, the sealer is separated from the opening, and when the electromagnet is powered off, the magnetic piece moves apart from the electromagnet, and the sealer is attached to the opening.

As a further improvement of the present invention, wherein the refrigerant amount regulator further comprises a control connected with the electromagnet, for obtaining operation information of the refrigerator to control the electromagnet to be powered on or off.

As a further improvement of the present invention, wherein the adjustor further comprises a spring, both ends of which are connected with the electromagnet and the magnetic piece respectively; when the electromagnet is powered off, no external force acts on the spring, and the spring enables the sealer to be attached to the opening, and when the electromagnet is powered on, the magnetic piece is attracted to the electromagnet to separate the seal part sealer from the opening.

As a further improvement of the present invention, wherein the adjustor further comprises a connecting rod for connecting the sealer with the magnetic piece.

As a further improvement of the present invention, wherein the refrigerant amount regulator further comprises a communicating pipe connected with the opening to communicate the storage cavity with the pipe.

As a further improvement of the present invention, wherein a side of the sealer close to the opening is made of an elastic material to seal the opening through deformation.

The present invention has the beneficial effects as follows. The refrigerator cooling system according to the present invention includes the pipe which forms the loop and the compressor, the condenser, the refrigerant amount regulator, the capillary tube and the evaporator which are provided on the pipe successively. When the refrigerant of the cooling system is required to be increased or reduced, the sealer is separated from the opening to open the opening, the refrigerant in the storage cavity flows into the cooling system or the refrigerant in the cooling system flows into the storage cavity, and after the set period of time, the sealer is attached to the opening to close the opening. An electromagnet is controlled to be powered on or off by a control which is with a simple structure and convenient control, so as to open or close the refrigerant amount regulator, such that under different external conditions, a load of the compressor may be regulated in time, the service life thereof is longer, and energy consumption of the refrigerator is optimized, thereby saving more energy and achieving a better refrigerating effect.

Figure 1:
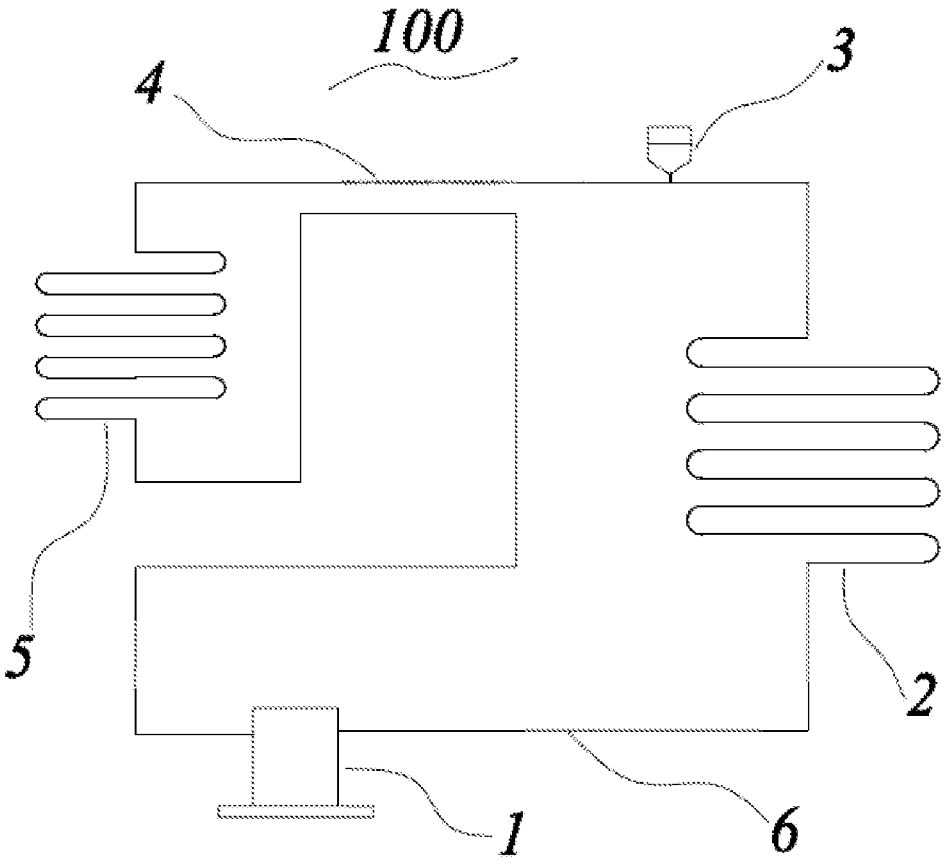
FIG. 1 is a schematic diagram of a refrigerator cooling system capable of regulating an amount of refrigerator automatically according to the present invention.

In the drawings, 100—cooling system; 1—compressor; 2—condenser; 3—refrigerant amount regulator; 4—capillary tube; 5—evaporator; 6—pipe; 31—storage device; 32—adjustor; 311—storage cavity; 312—opening; 321—sealer; 322—magnetic piece; 323—electromagnet; 324—spring; 325—connecting rod; 33—control; 34—communicating tube.

DETAILED DESCRIPTION

In order to make the objects, the technical solutions and the advantages of the present application much clear, the technical solutions of the present application will be described hereinafter in a clear and complete manner in conjunction with the embodiments of the present application and corresponding drawings. Based on the embodiments in the present application, all other embodiments obtained by a person skilled in the art without any creative effort shall fall within the protection scope of the present application.

Reference will be made in detail to embodiments of the present application, and the examples of the embodiments are illustrated in the drawings, wherein the same or similar elements and the elements having same or similar functions are denoted by like reference numerals throughout the descriptions. The embodiments described herein with reference to drawings are illustrative, and merely used to explain the present application. The embodiments shall not be construed to limit the present application.

In the description of the present invention, it should be noted that unless specified or limited otherwise, the terms "mounted", "connected", and "coupled" and the like are used broadly, and may be, for example, mechanical or electrical connections; may also be inner communications of two elements, direct connections or indirect connections via intervening structures. The above terms can be understood by those skilled in the art according to specific situations.

As shown in FIG. 1, the present invention provides a cooling system 100 for a refrigerator capable of regulating an amount of refrigerant automatically, the cooling system 100 including a pipe 6 which forms a loop, and a compressor 1, a condenser 2, a refrigerant amount regulator 3, a capillary tube 4 and an evaporator 5 which are provided on the pipe 6 successively.

Figure 2:
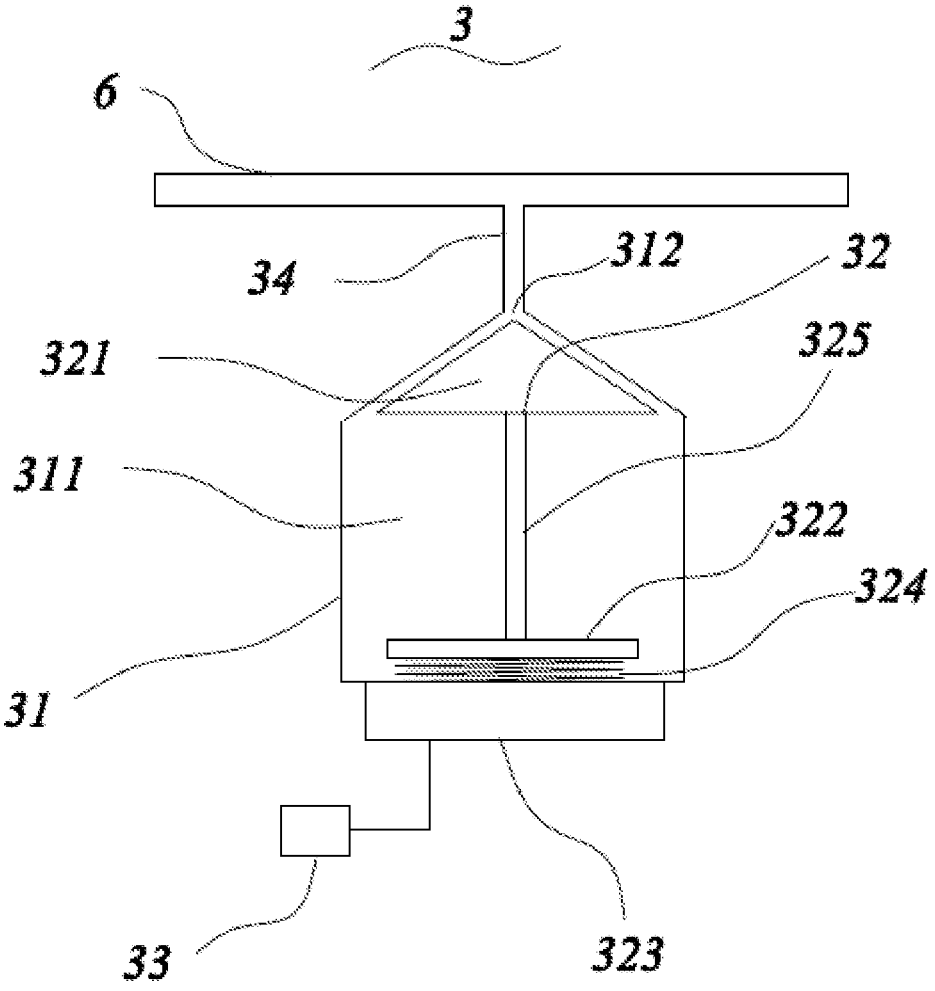
FIG. 2 is a schematic structural diagram of a refrigerant amount regulator according to an embodiment of the present invention.

In the present invention, as shown in FIG. 2, the refrigerant amount regulator 3 includes a storage device 31 and an adjustor 32 provided within the storage device, wherein a storage cavity 311 is formed inside the storage device 31 to accommodate a refrigerant, an opening 312 is formed at a distal end of a funnel-shaped inner wall of the storage device 31 to communicate the storage cavity 311 with the pipe 6, and the adjustor 32 includes a sealer 321 configured for opening or closing the opening 312. The sealer 321 is shaped and configured to be tightly engaged with the inner wall of the storage device 31.

Generally, in the cases where an environment temperature is relatively low or a small number of articles is stored in the refrigerator actually, or the like, the operating refrigerator has a small refrigerating demand; specifically, in the present embodiment, the relatively low environment temperature refers to a temperature lower than 5 Celsius degrees, and the case where a small number of articles is stored in the refrigerator actually refers to the case where a storage volume of the refrigerator for the articles is less than one tenth of an actual volume of the refrigerator.

In general, in the cases of the relatively high environment temperature, startup of the refrigerator or a large number of articles loaded at a time, or the like, the operating refrigerator has a great refrigerating demand; specifically, in the present embodiment, the relatively high environment temperature refers to a temperature higher than 30 Celsius degrees.

Thus, when the refrigerator has the small refrigerating demand, the amount of refrigerant of the cooling system 100 is required to be reduced; when the compressor 1 is operating, the pipe 6 is in a high pressure state, and the sealer 321 is separated from the opening 312 to open the opening; since an intensity of pressure in the pipe 6 is greater than an intensity of pressure in the storage cavity 311, the refrigerant in the cooling system 100 flows into the storage cavity 311, and the refrigerant in the storage cavity 311 becomes a high pressure liquid refrigerant. After a set period of time, the sealer 321 is attached to the opening 312, and the refrigerant amount regulator 3 is closed.

When the refrigerator has the large refrigerating demand, the amount of refrigerant of the cooling system 100 is required to be increased; when the compressor 1 is stopped, the pipe 6 is in a low pressure state, and the sealer 321 is separated from the opening 312 to open the opening; since the intensity of pressure of the storage cavity 311 is greater than the intensity of pressure in the pipe 6, the refrigerant in the storage cavity 311 flows into the cooling system 100, and the refrigerant in the storage cavity 311 becomes a low pressure gas refrigerant. After a set period of time, the sealer 321 is attached to the opening 312, and the refrigerant amount regulator 3 is closed.

In addition, when the refrigerator has the great or small refrigerating demand, once the pressure of the storage cavity 311 is consistent with the pressure in the pipe 6, the refrigerant does not move after the opening 312 is opened.

The amount of refrigerant of the cooling system 100 is regulated by opening and closing the refrigerant amount regulator 3, such that under different external conditions, the load of the compressor 1 may be regulated in time, the service life thereof is longer, and the energy consumption of the refrigerator is optimized, thereby saving more energy and achieving better refrigerating effects.

Preferably, the set period of time ranges from 30 to 120 seconds.

In the present embodiment, the adjustor 32 further includes an electromagnet 323 and a magnetic piece 322 connected with the sealer 321 fixedly. The electromagnet 323 is fixed at a side apart from the opening to generate an acting force with the magnetic piece 322, thereby driving the sealer 321 to be separated from or attached to the opening 312.

In the present embodiment, the magnetic piece 322 is configured as a magnetic substance, such as a magnet, iron, cobalt, nickel, or the like.

Further, the refrigerant amount regulator 3 further includes a control 33 connected with the magnet 323, for obtaining operation information of the refrigerator and judging whether there is a great or small amount of refrigerant in the cooling system 100, thereby controlling the electromagnet 323 to be powered on or off. The operation information of the refrigerator includes the above-mentioned environment temperature information, the information on the number of articles actually stored in the refrigerator, or the like. Certainly, the objects of the present invention may be realized with other control structures, such as a solenoid valve, or the like, as long as the opening 312 may be opened and closed.

When the amount of refrigerant of the cooling system 100 is required to be reduced or increased, the electromagnet 323 is powered on, then becomes magnetic and is attracted to the magnetic piece 322, and the magnetic piece 322 moves towards the electromagnet 323, such that the sealer 321 is driven to be separated from the opening 312, the refrigerant amount regulator 3 is opened, and the refrigerant in the storage cavity 311 flows into the cooling system 100 or the refrigerant in the cooling system 100 flows into the storage cavity 311. After a set period of time, the electromagnet 323 is powered off, then loses the magnetism and is disconnected with the magnetic piece 322 without an acting force, and the magnetic piece 322 moves apart from the electromagnet 323, thereby driving the sealer 321 to attach to the opening 312, and closing the refrigerant amount regulator 3.

Further, the adjustor 32 further includes a spring 324, both ends of which are connected with the electromagnet 323 and the magnetic piece 322 respectively. When the electromagnet 323 is powered on, the magnetic piece 322 is attracted to the electromagnet 323, and the spring is compressed by a deformation force, thereby separating the sealer 321 from the opening 312.

When the electromagnet 323 is powered off, the electromagnet 323 loses the magnetism, and the spring 324 is not subjected to the deformation force and returns to an original state, thereby attaching the sealer 321 to the opening 312. By the control 33 controlling the electromagnet 323 to be powered on or off, the refrigerant amount regulator 3 is opened and closed, with a simple structure and convenient control.

Specifically, the adjustor 32 further includes a connecting rod 325 for connecting the sealer 321 with the magnetic piece 322.

In the present embodiment, the refrigerant amount regulator 3 further includes a communicating pipe 34 connected with the opening 312 to communicate the storage cavity 311 with the pipe 6.

Specifically, a side of the sealer 321 close to the opening 312 is made of an elastic material, so as to be deformed to seal the opening when the sealer 321 is driven to be attached to the opening 312.

Thus, in conclusion, for the cooling system 100 for a refrigerator according to the present invention, the amount of refrigerant in the cooling system 100 is regulated by opening and closing the refrigerant amount regulator 3, with the simple structure and convenient control, such that under different external conditions, the load of the compressor 1 may be regulated in time, the service life is longer, and the energy consumption of the refrigerator is optimized, thereby saving more energy and achieving better refrigerating effects.

The above descriptions are merely preferable embodiments of the present invention. It should be noted that for a person skilled in the art, several variations and improvements may be made without departing from the conception of the present invention, and shall fall within the protection scope of the present invention.

What is claimed is:

1. A refrigerator cooling system, capable of regulating an amount of refrigerant automatically, comprising a pipe which forms a loop, and a compressor, a condenser, a refrigerant amount regulator, a capillary tube and an evaporator which are provided on the pipe successively;

the refrigerant amount regulator comprises a storage device and an adjustor provided within the storage device, wherein a storage cavity is formed inside the storage device to accommodate a refrigerant, an opening is formed in the storage device to communicate the storage cavity with the pipe, and the adjustor comprises a sealer configured for opening or closing the opening;

when the refrigerant of the cooling system is required to be increased, when the compressor is stopped, the sealer is separated from the opening to open the opening, the refrigerant in the storage cavity flows into the cooling system through the opening, and after a first set period of time, the sealer is attached to the opening to close the opening;

when the refrigerant of the cooling system is required to be reduced, when the compressor is operating, the sealer is separated from the opening to open the opening, the refrigerant in the cooling system flows into the storage cavity through the opening, and after a second set period of time, the sealer is attached to the opening to close the opening.

2. The refrigerator cooling system according to claim 1, wherein the first set period of time ranges from 30 to 120 seconds, and the second set period of time ranges from 30 to 120 seconds.

3. The refrigerator cooling system according to claim 1, wherein the adjustor further comprises an electromagnet and a magnetic piece connected with the sealer fixedly, wherein the electromagnet is fixed at a side apart from the opening; when the electromagnet is powered on, the magnetic piece moves towards the electromagnet, the sealer is separated from the opening, and when the electromagnet is powered off, the magnetic piece moves apart from the electromagnet, and the sealer is attached to the opening.

4. The refrigerator cooling system according to claim 3, wherein the refrigerant amount regulator further comprises a control connected with the electromagnet, for obtaining operation information of the refrigerator to control the electromagnet to be powered on or off.

5. The refrigerator cooling system according to claim 3, wherein the adjustor further comprises a spring, both ends of which are connected with the electromagnet and the magnetic piece respectively; when the electromagnet is powered off, no external force acts on the spring, and the spring enables the sealer to be attached to the opening, and when the electromagnet is powered on, the magnetic piece is attracted to the electromagnet to separate the sealer from the opening.

6. The refrigerator cooling system according to claim 3, wherein the adjustor further comprises a connecting rod for connecting the sealer with the magnetic piece.

7. The refrigerator cooling system according to claim 1, wherein the refrigerant amount regulator further comprises a communicating pipe connected with the opening to communicate the storage cavity with the pipe.

8. The refrigerator cooling system according to claim 1, wherein a side of the sealer close to the opening is made of an elastic material to seal the opening through deformation.

9. The refrigerator cooling system according to claim 1, wherein the opening is formed at a distal end of a funnel-shaped inner wall of the storage device, and the sealer is shaped and configured to be engaged with the inner wall of the storage device.

* * * * *